US010316461B2

(12) United States Patent
Bae et al.

(10) Patent No.: US 10,316,461 B2
(45) Date of Patent: Jun. 11, 2019

(54) DRYING MACHINE

(71) Applicant: LG Electronics Inc., Seoul (KR)

(72) Inventors: Jinwoo Bae, Seoul (KR); Sanghun Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 894 days.

(21) Appl. No.: 14/333,214

(22) Filed: Jul. 16, 2014

(65) Prior Publication Data

US 2015/0020398 A1 Jan. 22, 2015

(30) Foreign Application Priority Data

Jul. 19, 2013 (KR) ..... 10-2013-0085406
Jun. 19, 2014 (KR) ..... 10-2014-0075039

(51) Int. Cl.
*D06F 58/20* (2006.01)
*D06F 58/24* (2006.01)
(Continued)

(52) U.S. Cl.
CPC ..... *D06F 58/24* (2013.01); *D06F 58/02* (2013.01); *D06F 58/206* (2013.01); *D06F 58/20* (2013.01); *F26B 7/005* (2013.01); *F26B 21/083* (2013.01)

(58) Field of Classification Search
CPC ..... D06F 58/24; D06F 58/02; D06F 58/206; F26B 7/005; F26B 21/083
(Continued)

(56) References Cited

U.S. PATENT DOCUMENTS 7,017,356 B2 * 3/2006 Moffitt ..... F24F 3/1423 62/91
7,785,398 B2 * 8/2010 Dewald, III ..... D06F 58/24 34/80
(Continued)

FOREIGN PATENT DOCUMENTS

DE 36 26 887 A1 2/1988
EP 1 247 888 A1 10/2002
(Continued)

OTHER PUBLICATIONS

Partial English Machine Translation: JP 2002066194. Accessed Jun. 2017.*
(Continued)

*Primary Examiner* — Jianying C Atkisson
*Assistant Examiner* — Tavia Sullens
(74) *Attorney, Agent, or Firm* — Birch, Stewart, Kolasch & Birch, LLP

(57) ABSTRACT

A drying machine includes a clothes holding unit for holding clothes therein, a drying passage including a heater to supply heated air to the clothes holding unit, a dehumidification passage for removing moisture from the air exhausted from the clothes holding unit to supply dehumidified air to the drying passage, a circulation fan provided in the drying passage or the dehumidification passage to circulate air, a moisture absorption unit for absorbing moisture from the air exhausted from the clothes holding unit, a renewable passage for supplying the heat absorbed by the dehumidified passage to the moisture absorption unit to renew the moisture absorption unit, and a controller for controlling the circulation fan to circulate the air exhausted from the clothes holding unit for a preset time period.

13 Claims, 4 Drawing Sheets

(51) Int. Cl.
*F26B 7/00* (2006.01)
*F26B 21/08* (2006.01)
*D06F 58/02* (2006.01)

(58) Field of Classification Search
USPC ..... 34/299, 80, 81
See application file for complete search history.

(56) References Cited

U.S. PATENT DOCUMENTS

| | | | | |
|---|---|---|---|---|
| 8,137,440 | B2 | 3/2012 | Dewald, III et al. | |
| 9,146,040 | B2 * | 9/2015 | DeValve ..... | F24F 3/1423 |

FOREIGN PATENT DOCUMENTS

| | | | | |
|---|---|---|---|---|
| EP | 1 669 687 | A2 | 6/2006 | |
| JP | 11-76696 | A | 3/1999 | |
| JP | 2002-066194 | A | 3/2002 | |
| JP | 2007-306960 | A | 11/2007 | |
| JP | 2011-010769 | A | 1/2011 | |
| JP | 2012-29783 | A | 2/2012 | |
| JP | 2012-161355 | A | 8/2012 | |
| WO | WO 02/03002 | A1 | 1/2002 | |
| WO | WO 2005/012624 | A1 | 2/2005 | |
| WO | WO 2012087273 | A1 * | 6/2012 | ..... F24F 3/1423 |

OTHER PUBLICATIONS

JPH1176696: Partial English Machine Translation. Accessed Dec. 2017.*

* cited by examiner

[Fig. 4]
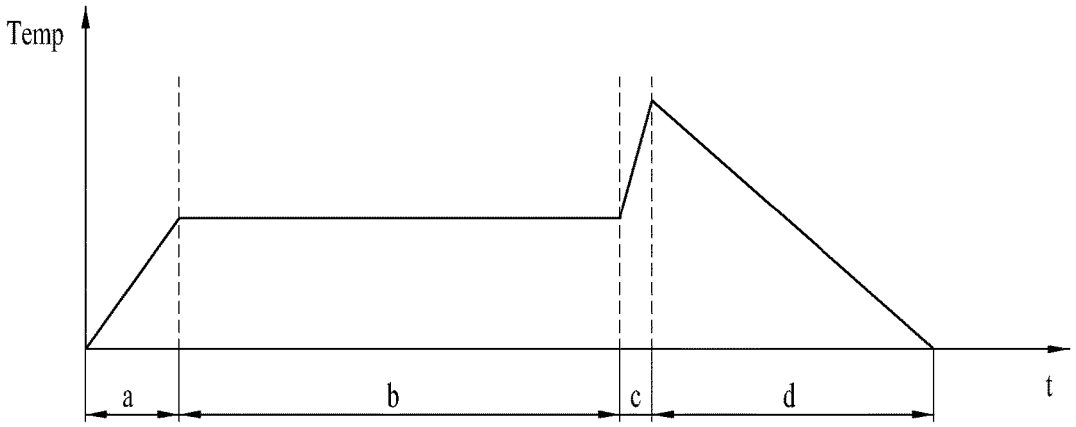

DRYING MACHINE

Pursuant to 35 U.S.C. § 119(a), this application claims the benefit of Korean Patent Application No. 10-2013-0085406, filed on Jul. 19, 2013 and Korean Patent Application No. 10-2014-0075039, filed on Jun. 19, 2014, which are hereby incorporated by reference as if fully set forth herein.

BACKGROUND OF THE INVENTION

Field of the Invention

Embodiments of the present disclosure relate to a drying machine.

Discussion of the Related Art

Generally, a drying machine is an electric home appliance for drying clothes. Such a drying machine is mainly classified into a condensation type and an exhaustion type. In the condensation type drying machine, the air having dried clothes is condensed by a sensible heat exchange to remove moisture from the clothes. In the exhaustion type drying machine, the air having dried clothes is exhausted outside.

The condensation type drying machine is classified into an air cooling condensation type drying machine and a water cooling condensation type drying machine.

In the water cooling condensation type drying machine, a heat exchanger is installed in a predetermined portion of a circulation passage for circulating air and a low temperature cooling water is supplied to the heat exchanger to condense moisture contained in the circulated air and the moisture is removed accordingly.

Auxiliary cooling water has to be supplied and a drying time is relatively long in such the water cooling condensation type drying machine.

In contrast, a heat exchanger is installed on a circulation passage and air for cooling is sucked from the outside to pass the heat exchanger and the air for cooling condenses the circulated air only to remove the moisture in the air cooling condensation type drying machine.

Such the air cooling condensation type drying machine sucks the air for cooling from the outside and the sucked passes the heat exchanger. After that, such the air is exhausted into a cabinet or outside (to a room).

At this time, in case humid air having an enough humidity to be removed by the heat exchanger provided in a conventional air cooling condensation type drying machine, the drying of clothes might not be performed normally and a drying performance might be deteriorated accordingly.

Moreover, the conventional air cooling condensation type drying machine exhausts the air for cooling after passing the heat exchanger to an internal space of the cabinet or an outer space of the cabinet (the room), in a state of having an intermediate temperature (e.g., 50~60° C.). In this instance, air with a predetermined thermal energy happens to be left over and it is inefficient in an aspect of energy saving.

In case the air after passing the heat exchanger provided in the conventional air cooling condensation type drying machine is exhausted to the internal space of the cabinet as it is in the intermediate temperature (approximately 50~60° C.), a motor and the like could be negatively influenced and the internal space of the cabinet could not be clean. In case the air is exhausted to the external space of the cabinet (the room), the air might heighten the temperature in the room enough to give an unpleasant feeling to a user and the noise might be generated by the air exhaustion.

Accordingly, there is increasing necessity for using the thermal energy contained in the intermediate temperature air having passed the heat exchanger and for enhancing the drying performance.

SUMMARY OF THE INVENTION

To overcome the disadvantages, embodiments of the present disclosure is directed to a drying machine.

Embodiments of the disclosure provide a drying machine which includes a dehumidification unit as well as a heat exchanger to enhance a drying performance.

To achieve these objects and other advantages and in accordance with the purpose of the embodiments, as embodied and broadly described herein, a drying machine includes a clothes holding unit for holding clothes therein; a drying passage comprising a heater to supply heated air to the clothes holding unit; a dehumidification passage for removing moisture from the air exhausted from the clothes holding unit to supply dehumidified air to the drying passage; a circulation fan provided in the drying passage or the dehumidification passage to circulate air; a moisture absorption unit for absorbing moisture from the air exhausted from the clothes holding unit; a renewable passage for supplying the heat absorbed by the dehumidified passage to the moisture absorption unit to renew the moisture absorption unit; and a controller for controlling the circulation fan to circulate the air exhausted from the clothes holding unit for a preset time period.

The drying machine may further include a renewable fan provided in the renewable passage to supply air outside the dehumidification passage to an internal space of the renewal passage.

The dehumidification passage may include a condensation passage comprising a heat exchanger for condensing moisture from the air exhausted from the clothes holding unit; and a moisture absorption passage comprising the moisture absorption unit to absorb moisture from the air.

The moisture absorption unit may include a renewable unit provided in the renewable passage; and a moisture absorption unit for absorbing moisture from the air.

The moisture absorption unit may include a desiccant for absorbing moisture; and a housing for holding the desiccant.

The drying machine may further include a motor for rotating the desiccant absorbing the moisture to change a location of the desiccant.

The controller may change the location of the desiccant when the exposed time of the desiccant to the moisture absorption passage passes a preset reference time.

The moisture absorption passage may be connected with the condensation passage in serial.

The moisture absorption passage may be connected with the condensation passage in parallel.

The drying machine may further include a passage change damper provided in a connected portion between the condensation passage and the moisture absorption passage to supply the air circulating after passing the circulation fan to the condensation passage or the moisture absorption passage selectively.

The drying machine may further include a passage change damper to supply the air circulating by the circulation fan to both of the condensation passage and the moisture absorption passage or to either of the condensation passage and the moisture absorption passage.

The drying machine may further include a renewable fan provided in the renewable passage to supply external air of the dehumidification passage into the renewable passage, wherein in case the condensation passage is open by the passage change damper and the moisture absorption passage is closed, the controller drives the circulation fan, the renewable fan and the heater.

The renewable passage may further include a renewable fan for supplying external air of the dehumidification passage to the inside of the renewable passage, and the moisture absorption unit may include a renewable portion provided in the renewable passage and a moisture absorption portion provided in the moisture absorption passage to absorb the moisture from the air. When the condensation passage is closed and the moisture absorption passage is open by the passage change damper, the controller may stop the heater and the renewable fan and drive the circulation fan.

In another aspect, a drying machine includes a drum rotatably provided to hold clothes therein; a passage for circulating air to enable the air exhausted from the drum to be re-supplied to the drum; a heater and a circulation fan which are provided in the passage; a heat exchanger provided in the passage to exchange heat with the air circulating the passage and to condense some of the air circulating the passage; a moisture absorption unit for absorbing moisture from the air circulating along the passage after exhausted from the drum; and a renewable passage for supplying air outside the passage to the moisture absorption unit after passing the heat exchanger.

According to at least one embodiment of the disclosure, the dehumidification unit as well as the heat exchanger may be provided in the drying machine, such that the drying machine may have an improved drying performance.

Furthermore, the waste heat generated in the heat exchanger provided in the drying machine can be reused to renew the dehumidification unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the disclosed subject matter and are incorporated in and constitute a part of this specification, illustrate exemplary embodiments of the disclosed subject matter, and together with the description serve to explain the principles of the disclosed subject matter:

FIG. 4 illustrates change in temperatures of the air exhausted from the clothes holding unit during a drying course.

DETAILED DESCRIPTION OF THE INVENTION

Figure 1:
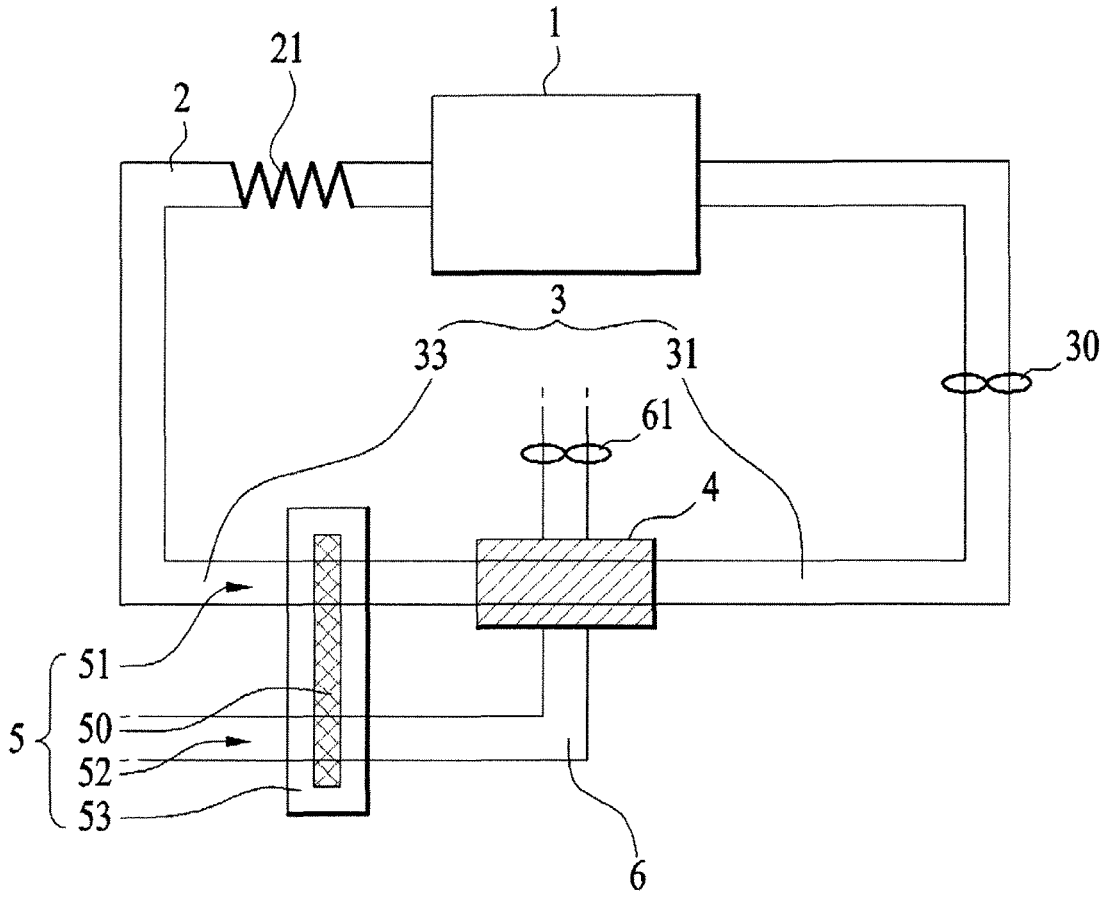
FIG. 1 illustrates one embodiment of a drying machine in accordance with the disclosure.

Exemplary embodiments of the disclosed subject matter are described more fully hereinafter with reference to the accompanying drawings. The disclosed subject matter may, however, be embodied in many different forms and should not be construed as limited to the exemplary embodiments set forth herein. Rather, the exemplary embodiments are provided so that this disclosure is thorough and complete, and will convey the scope of the disclosed subject matter to those skilled in the art. In the drawings, the size and relative sizes of layers and regions may be exaggerated for clarity. Like reference numerals in the drawings denote like elements.

FIG. 1 illustrates one embodiment of a drying machine in accordance with the disclosure.

As shown in FIG. 1, a drying machine in accordance with the disclosure includes a clothes holding unit 1 rotatably provided to hold clothes therein and passages 2 and 3 for guiding the air which has exchanged heat with the clothes held in the clothes holding unit 1 toward the clothes holding unit 1 again. The clothes holding unit 1 may be in the form of a rotatable drum 1.

On the passages 2 and 3 may be provided a circulation fan 30 for circulating air along the passages 2 and 3.

The passages 2 and 3 for circulating the air therein may include a drying passage 2 provided to supply high temperature dry air to the clothes holding unit 1 and a dehumidification passage 3 provided to remove moisture from the air exhausted from the clothes holding unit 1.

A heater 21 may be provided on the drying passage 2 to supply the heat used in heating the circulation air supplied to the clothes holding unit 1 to be a high temperature air.

The high temperature dry air supplied to the clothes holding unit 1 sucks the moisture from the clothes to dry the clothes and the air exhausted from the clothes holding unit 1 (or the air which has exchanged heat with the clothes) is humid air.

The humid air exhausted from the clothes holding unit 1 may move toward the dehumidification passage 3 and a heat exchanger 4 for condensing the moisture contained in air is provided in the dehumidification passage 3.

The disclosure relates to a condensation type drying machine (or a drying machine for circulating the air exhausted from the clothes holding unit) and it is necessary to provide the condensation type drying machine in accordance with the disclosure with the heat exchanger 4 for generating the dry air condensed from humid air.

The heat exchanger 4 may condense the moisture contained in air, using the heat of the humid air passing the dehumidification passage 3, and dehumidify the humid air.

In this instance, the disclosure relates to an air cooling condensation type drying machine. In the disclosure, the air for cooling outside the dehumidification passage 3 is sucked to pass the heat exchanger 4 provided on the dehumidification passage 3.

As a result, the humid air passing the heat exchanger in the dehumidification passage 3 has heat removed by external air for cooling and the moisture contained in the air is condensed.

As shown in FIG. 1, the drying machine in accordance with the disclosure may further include a moisture absorption unit 5, in addition to the heat exchanger 4. The moisture absorption unit 5 is means for sucking the moisture contained in the air exhausted from the clothes holding unit 1.

The heat exchanger 4 has a restricted performance for condensing the humid air and cannot condense the air having more humidity over the restricted performance, such that drying of the clothes may not be performed.

For that, the moisture absorption unit 5 may be further provided to dehumidify the humid air, as well as the heat exchanger 4. Such the moisture absorption unit 5 will be described in detail later.

A renewable passage 6 may be further provided to supply the heat sucked from the dehumidification passage 3 to the moisture absorption unit 5.

As mentioned above, the heat exchanger 4 provided on the dehumidification passage 3 enables external air for cooling to suck heat from the humid air such that the external air can be changed into intermediate temperature air.

Such intermediate temperature air may be supplied to the moisture absorption unit 5, without being exhausted outside directly, and it is preferred that the renewable passage 6 to form a passage in which the intermediate temperature air with the sucked heat moves.

The reason why the intermediate temperature air is supplied to the moisture absorption unit 5 is to renew the moisture absorption unit 5 and regeneration of the moisture absorption unit 5 will be described in detail later.

The renewable passage 6 may form a passage of air for cooling which is supplied to the heat exchanger 4 provided in the dehumidification passage 3.

The renewable passage 6 may include a renewable fan 61 for sucking the air for cooling outside the dehumidification passage 3 into the renewable passage 6.

In other words, when the air for cooling outside the dehumidification passage 3 is sucked into the renewable passage 6 by the renewable fan 61, the air for cooling cools the heat exchanger 4 and the dehumidification passage 3 circulating air is dehumidified while passing the heat exchanger.

The circulating air has heat sucked by the air for cooling, to condense the moisture contained therein and the air for cooling sucks the heat from the circulating air to be the intermediate temperature air, such that the intermediate temperature air may move to the renewable passage 6.

The intermediate temperature air moving through the renewable passage 6 may be supplied to the moisture absorption unit 5 to renew the moisture absorption unit 5.

Meanwhile, the dehumidification passage 3 includes the heat exchanger 4 and the moisture absorption unit 5, to remove the moisture from the humid air.

At this time, the method performed by the heat exchanger 4 to remove the moisture is different from the method performed by the moisture absorption unit 5 to remove the moisture. Accordingly, the dehumidification passage 3 may be divided into a condensation passage 31 and a moisture absorption passage 33.

The condensation passage 31 may include the heat exchanger 4 to condense the moisture contained in the humid air exhausted from the clothes holding unit 1 and it may be functioned as a passage for circulating the air.

The moisture absorption passage 33 may include the moisture absorption unit 5 to absorb the moisture contained in the air and it may be functioned as a passage for circulating the air.

The condensation passage 31 and the moisture absorption passage 33 may be provided in serial or parallel and the arrangement and effects of the passages will be described in detail later.

The drying machine in accordance with the disclosure may include a controller (not shown).

The condensation type drying machine in accordance with the disclosure may dry the clothes held in the clothes holding unit 1, using the air circulated repeatedly. At this time, the temperature inside the clothes holding unit 1 increases in a preset time period after the drying operation and there is little difference between the temperature of the air and the temperature of the clothes holding unit 1.

In other words, a drying efficiency achieved by the heater 21 deteriorates in the latter half of the drying process. Accordingly, when using the heater 21 continuously, a relatively lower drying efficiency cannot help being achieved in comparison with energy consumption.

Once a preset time passes after a drying cycle starts the operation of the heater 21 stops. The controller controls the air to circulate the passages 2 and 3 for a preset time period continuously, even though the operation of the heater 21 stops.

In other words, the temperature of the air circulating the passages 2 and 3 is sufficiently heightened in the preset time period after the drying cycle and the controller stops the heater and the circulation fan 30 to operate continuously, such that the humidity of the air may be removed only by the moisture absorption unit 5 and that the high temperature dry air may be supplied to the clothes holding unit 1.

To overcome the disadvantage that the low drying efficiency, compared with the energy consumed by the continuously used heater 21, the controller stops the operation of the heater 21 after the drying cycle starts and circulates the moisture absorption unit 5 for a preset reference time period for the air to pass the moisture absorption unit 5. Accordingly, an effect of energy saving can be achieved additionally.

The path of the air circulation may differ based on whether the moisture absorption passage 33 having the moisture absorption unit 5 and the condensation passage 31 are provided in serial or parallel, which will be described in detail later.

Hereinafter, the moisture absorption unit 5 provided in the moisture absorption passage 33 will be described in detail later, referring to FIG. 2.

Figure 2:
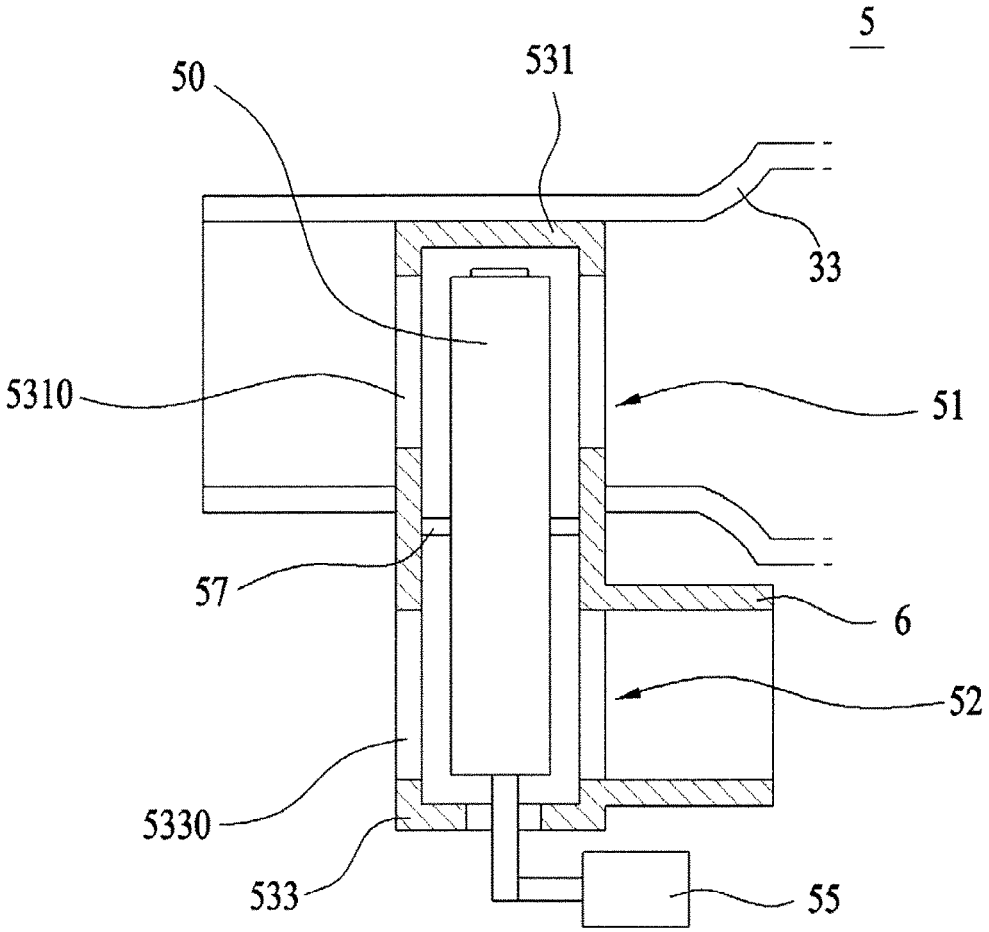
FIG. 2 illustrates a dehumidification unit in accordance with the disclosure.

The moisture absorption unit 5 shown in FIG. 2 may include a moisture absorption portion 51 and a renewable portion 52 based on the location where the moisture absorption unit 5 is provided.

The moisture absorption portion 51 may be provided on the moisture absorption passage 33 to absorb the moisture of the air circulating in the moisture absorption passage 33. The renewable portion 52 may be provided on the renewable passage 6 and the intermediate temperature air which has absorbed the heat from the heat exchanger 4 may pass the renewable portion 52.

The moisture absorption unit 5 may include a desiccant 50 for absorbing moisture and a housing 53 for holding the desiccant 50.

The desiccant 50 is provided in the housing 53 and it may be divided into some desiccant provided in the moisture absorption portion 51 and the other desiccant provided in the renewable portion 52.

The housing 53 may consist of a first housing 531 located in the moisture absorption portion 51 and a second housing 533 provided in the renewable portion 52.

A first hole 5310 may be formed in the first housing 531 to expose the desiccant 50 held therein to the air circulating in the moisture absorption passage 33.

The air circulating the moisture absorption passage 33 may contact with the desiccant 50 provided in the first housing 531 through the first hole 5310, such that the air passing the desiccant 50 can be dehumidified.

Moreover, a second hole 5330 may be provided in the second housing 533 to expose the desiccant 50 held therein to the intermediate temperature air moving in the renewable passage 6.

The intermediate temperature air moving in the renewable passage 6 may contact with the desiccant 50 provided in the second housing 533 through the second hole 5330 such that the desiccant 50 having the moisture can be dried (or the moisture absorption unit 5 can be renewed).

The desiccant 50 may be any materials having a property for absorbing the moisture contained in the air.

The structure of the moisture absorption unit 5 shown in FIG. 2 is one of embodiments which can be proposed by the disclosure and it may be diversified only if it can realize the function mentioned above.

Meanwhile, the moisture absorption unit 5 may include a motor 55 for rotating the desiccant 50 and a shaft 57 on which the desiccant 50 is rotated as its axis. The motor 55 may directly rotate the shaft 57 or a belt in contact with the desiccant 50.

The motor 55 and the shaft 57 may rotate the desiccant 50 to change a location of the desiccant 50.

The rotation of the desiccant 50 enabled by the motor 55 and the shaft 57 may be one embodiment of the disclosure for change the location of the desiccant 50. Any configurations capable of changing the location of the desiccant 50 can be applicable.

Moisture absorption and renewal of the absorption unit 5 will be described as follows, together with the reason why the location of the desiccant 50 has to be changed.

The desiccant 50 absorbs the moisture from the air inside the moisture absorption passage 33. In other words, a preset portion of the desiccant 50 provided in the location of the moisture absorption portion 51 absorbs the moisture from the air flowing along the moisture absorption passage 33.

The amount of the moisture absorbable by the desiccant 50 is limited. When the absorption amount of the desiccant 50 reaches saturation, it is necessary to replace the desiccant 50.

However, the desiccant 50 is provided in the drying machine 100 and it is practically impossible to replace the desiccant 50 every time.

Accordingly, it is required to change the location of the desiccant 50.

Some desiccant 50 provided in the renewable portion 52 is located on the renewable passage 6 such that it cannot absorb the moisture from the air passing the moisture absorption passage 33. It is preferred that the location of the desiccant 50 is changed to locate some of the desiccant provided in the renewable portion 52 in the moisture absorption portion 51.

At this time, some desiccant 50 provided in the location of the moisture absorption portion 51 may be provided in the location of the renewable portion 52 by the change of the location mentioned above.

The renewable portion 52 may be provided on the renewable passage 6 and the intermediate temperature air after passing the heat exchanger 4 may pass the renewable portion 52. Accordingly, the desiccant 50 provided in the renewable portion 52 may be dried by the intermediate temperature air.

The process that the desiccant 50 having absorbed the moisture to saturation may be re-dried by the intermediate temperature air passing through the renewable passage 6 may be called "renewal of the desiccant 50" or "renewal of the moisture absorption unit 5".

The renewed desiccant 50 may move to the moisture absorption portion 51 from the renewable portion 52. The desiccant 50 which has reached the moisture absorption portion 51 may absorb the moisture from the air passing the moisture absorption passage 33.

Typically, when the desiccant 50 absorbs the moisture, an auxiliary heat source has to be provided to dry the desiccant 50 so as to re-use the desiccant 50.

However, in the structure of the drying machine in accordance with the disclosure, the intermediate temperature air heated while it is passing the heat exchanger 4 and a waste heat possessed by the intermediate temperature air may be recycled as a renewal heat source of the moisture absorption unit 5.

Not throwing away the waste heat but recycling the waste heat, the waste heat may be used as the heat source of the moisture absorption unit 5 and not auxiliary heat source for renewing the absorption unit 5 is required.

It is uncomfortable for the user to move the desiccant 50 directly, when changing the location of the desiccant 50, and it is then practically impossible.

Accordingly, the controller may change the location of the desiccant 50 when a reference time period passes preset by the user.

In other words, when some of the desiccant 50 located in the moisture absorption portion 51 absorbs the moisture to saturation (or when a preset time passes), the controller may control the motor 55 to change the location of the desiccant 50.

As mentioned above, the condensation passage 31 and the moisture absorption passage 33 may be provided in serial or parallel. Hereinafter, the connecting relation between the condensation passage 31 and the moisture absorption passage 33 will be described.

FIG. 1 illustrates the drying machine in which the condensation passage 31 and the moisture absorption passage 33 are provided in serial.

When the condensation passage 31 and the moisture absorption passage 33 are provided in serial, the air exhausted from the clothes holding unit 1 may primarily dehumidified while passing the heat exchanger 4 of the condensation passage 31 and secondarily dehumidified by the moisture absorption unit 5.

In case the condensation passage 31 and the moisture absorption passage 33 are provided in serial, the flow of the air passing the passages 2 and 3 will be described as follows.

The high temperature humid air exhausted from the clothes holding unit 1 passes the condensation passage 31. At this time, the circulation fan 30 may be provided in the condensation passage 31 to help the circulation of the air.

The high temperature humid air passing the condensation passage 31 may pass the heat exchanger 4 provided in the condensation passage 31. The air may be drawn into the moisture absorption passage 33 after condensed, while it is passing the heat exchanger 4.

The air which has passed the moisture absorption passage 33 is sucked into the drying passage 2 and the air sucked into the drying passage 2 is heated into dry air. The dry air is supplied to the clothes holding unit 1 and a drying course of the circulation type drying machine is performed, using the dry air.

When the condensation passage 31 and the moisture absorption passage 33 are provided in serial, the operation of the controller will be described as follows.

As mentioned above, the operation of the heater 21 stops in a preset time after the drying course starts. It is preferred that the controller may circulate the air to pass the moisture absorption unit 5 even after the stop of the heater 21, in an aspect of energy efficiency.

Specifically, even after stopping the operation of the heater 21, the controller may control the air exhausted from the clothes holding unit 1 to circulate in the dehumidification passage 3 and the drying passage 2 to be supplied to the clothes holding unit 1 repeatedly, such that the clothes can be dried.

Figure 3:
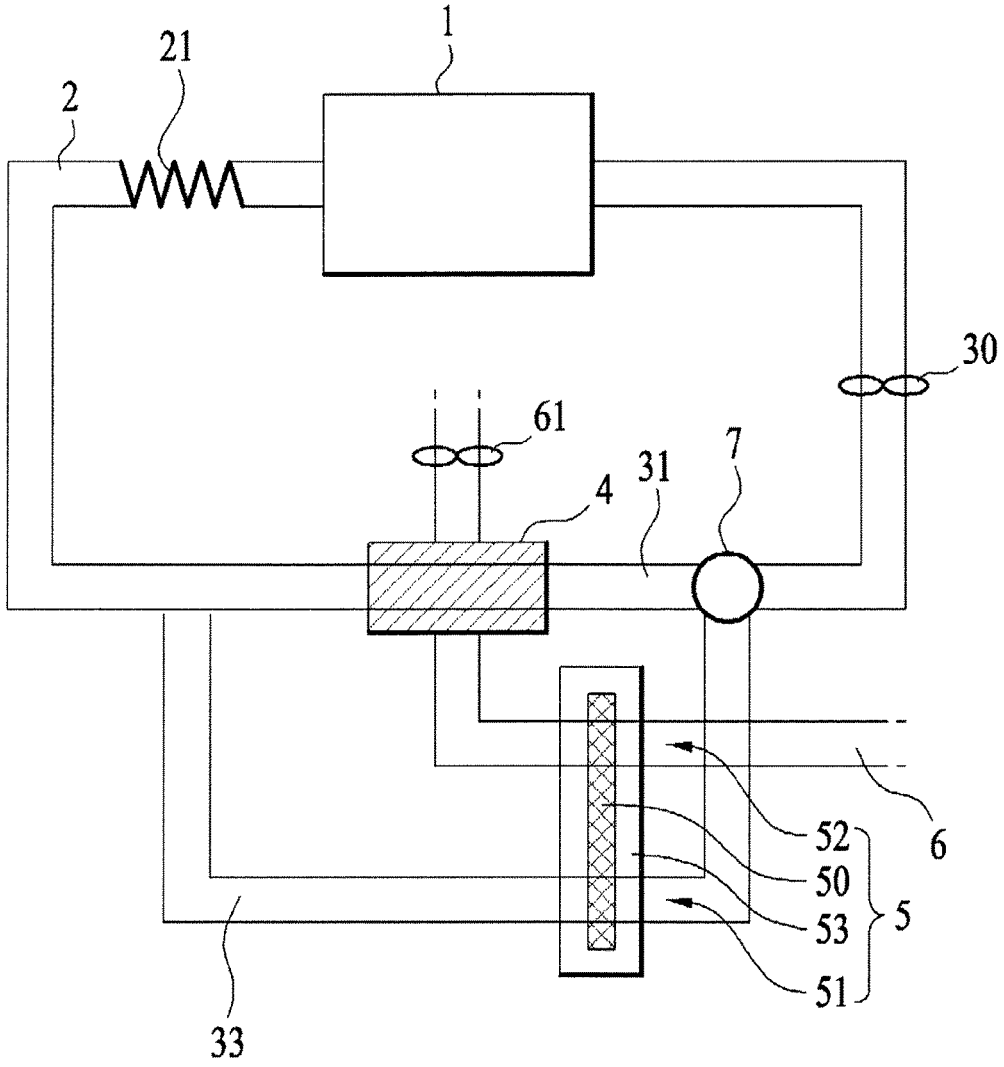
FIG. 3 illustrates another embodiment of a drying machine in accordance with the disclosure.

FIG. 3 is a diagram illustrating the structure of the drying machine in a state where the condensation passage 31 and the moisture absorption passage 33 are connected with each other in parallel.

When the condensation passage 31 and the moisture absorption passage 33 are connected in parallel as shown in FIG. 3 as another embodiment of the disclosure, the air circulating the passages 2 and 3 is divided as follows.

Specifically, the circulating air may be divided into the air dehumidified by the heat exchanger 4 provided in the condensation passage 31 and the air dehumidified by the moisture absorption unit 5.

When the condensation passage 31 and the moisture absorption passage 33 are provided in parallel, the flow of the air passing the passages 2 and 3 will be described as follows.

When the circulation fan 30 is put into operation, some of the high temperature humid air exhausted from the clothes holding unit 1 is flowing to the condensation passage 31 and the other amount of the high temperature humid air exhausted from the clothes holding unit 1 is flowing to the moisture absorption passage 33.

A passage change damper 7 may be further provided in the passages 2 and 3 to move the high temperature humid air only to one of the condensation passage 31 and the moisture absorption passage 33.

Accordingly, the high temperature humid air may be dehumidified by the heat exchanger 4 provided in the condensation passage 31 or it may be dehumidified only by the moisture absorption unit 5 provided in the moisture absorption passage 33.

The passage change damper 7 may be configured to control a direction of air flow so as to make the air flow along only one direction.

The passage change damper 7 may be provided in a connected portion of the condensation passage 31 with the moisture absorption passage 33.

The user may select the method in which the high temperature humid air is dehumidified while passing the condensation passage 31 or the method in which the high temperature humid air is dehumidified while passing the moisture absorption passage 33.

In one embodiment, a ratio of the air circulating the condensation passage 31 to the air circulating the moisture absorption passage 33 may be controlled to be 7:3 to maximize the drying efficiency.

The air dehumidified while passing the condensation passage 31 or the moisture absorption passage 33 may be sucked into the drying passage 2 and heated to be a high temperature dry air by the heater 21 provided in the drying passage 2.

Such the dry air is re-supplied to the clothes holding unit 1 to dry the clothes. After drying the clothes, the air is re-exhausted from the clothes holding unit 1. That process is repeated and the drying course of the condensation type drying machine is performed.

When the condensation passage 31 and the moisture absorption passage 33 are provided in parallel, the control of the controller will be described as follows.

As mentioned above, the operation of the heater stops in a preset time after the drying course starts. It is preferred that the controller circulates the air to pass the moisture absorption unit 5 even after the operation of the heater 21 stops, in an aspect of energy efficiency.

At this time, the controller has to control the circulation fan 30 and the passage change unit 7 (the passage change damper 7) to make the air to pass the moisture absorption unit 5.

In other words, it is preferred that the controller dries the clothes by operating the circulation fan 30 and controlling the passage change damper 7 to move the air exhausted from the clothes holding unit 1 to the moisture absorption passage 33 while operating the circulation fan 30 for a preset time period after the operation of the heater 21 stops.

FIG. 4 illustrates change in temperatures of the air exhausted from the clothes holding unit 1 during a drying course.

As shown in FIG. 4, the temperature of the air exhausted from the clothes holding unit 1 continuously rises in a first period (a) of the drying course. Most of the hot air supplied to the clothes holding unit 1 in the first period (a) is used in heightening the temperature inside the clothes holding unit 1 and the dryer, such that heat exchange between the hot air and the clothes may hardly happen.

As there is a little amount of the air heat-exchanged between the clothes and the hot air in the first period (a), the amount of moisture contained in the air exhausted from the clothes holding unit 1 in the first period (a) is smaller than the amount of moisture in a second period (b) in which the heat exchange between the clothes and the hot air is performed in earnest. Accordingly, there is less necessity of removing the moisture contained in the air, using the moisture absorption unit 5.

Accordingly, it is preferred that the controller controls the passage change unit 7 to open the condensation passage 31 and to close the moisture absorption passage 33 in the first period (a) of the drying course. In this instance, the controller drives the circulation fan 30, the heater 21 and the renewable fan 61.

Meanwhile, once the first period (a) of the drying course is complete (in other words, once the temperature inside the clothes holding unit 1 as well as the dryer reaches a preset temperature), a second period starts in which the temperature of the air exhausted from the clothes holding unit 1 is uniform. That is why the heat exchange between the hot air supplied to the clothes holding unit 1 and the clothes becomes active in the second period (b).

During the second period (b) of the drying course, the air exhausted from the clothes holding unit 1 contains much moisture and it is preferred that the controller controls the passage change damper 7 to open both the condensation passage 31 and the moisture absorption passage 33 in the second period (b).

In the second period (b), the controller drives the circulation fan 30, the heater 21 and the renewable fan 61 and also controls the motor 55 to move the desiccant 50 from the moisture absorption passage 33 to the renewable passage 6 at preset intervals.

Once the second period (b) of the drying course is complete, a third period (c) starts in which the temperature of the air exhausted from the clothes holding unit 1 rises. As a drying degree of clothes is getting higher, the hot air drawn into the clothes holding unit 1 is exhausted outside, with little heat exchange with the clothes.

The temperature of the air exhausted from the clothes holding unit 1 in the third period (c) is almost the same as the temperature of the hot air supplied to the clothes holding unit 1 (because the clothes are dried to a desired level), such that it is much less necessary to supply the hot air to the clothes holding unit 1 in the third period (c) of the drying course and to dehumidify the air exhausted from the clothes holding unit 1. Accordingly, it is preferred that the controller stops the operation of the heater 21 and the renewable fan 61 and keeps the operation of the circulation fan 30 in the third period (c).

Meanwhile, it is preferred that the controller controls the passage change damper 7 to close the condensation passage 31 and to open the moisture absorption passage 33.

The temperature of the clothes is high as passing the second period (b) of the drying course. Although the third period (c) of the drying course is performed in a state where the heater 21 is not operated, the temperature of the air exhausted from the clothes holding unit 1 is high. Accordingly, when the internal air of the clothes holding unit 1 is circulated via the moisture absorption passage 33 in the third period (c) of the drying course, the moisture remaining in the clothes may be removed even without operating the heater 21 and renewable fan 61.

Once the third period (c) of the drying course is complete, a fourth period (d) in which the temperature of the clothes is lowered may start. In the fourth period (d) of the drying course, the controller may drive the circulation fan 30. In this instance, the passage change damper 7 may open one of the condensation passage 31 and the moisture absorption passage 33 or open both of the condensation passage 31 and the moisture absorption passage 33.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A drying machine comprising:

a drum provided to hold clothes therein;

a dehumidification passage connected to a first side of the drum to exhaust air from inside the drum;

a drying passage connected to a second side of the drum to introduce air into the drum, the drying passage located adjacent to and being in fluid communication with the dehumidification passage;

a heat exchanger located in the dehumidification passage and configured to condense moisture from the air exhausted from the drum;

a renewable passage provided to pass through the heat exchanger and allow an external air to pass through the heat exchanger, the renewable passage being fluidly isolated from the drying passage and the dehumidification passage;

a circulation fan provided in the drying passage or the dehumidification passage to circulate air in the drum;

a moisture absorption assembly including a desiccant therein and including a portion in fluid communication with the drying passage and a portion in fluid communication with the renewable passage, wherein the dehumidification passage is in fluid communication with the heat exchanger and with the portion of the moisture absorption assembly in fluid communication with the drying passage; and a heater provided downstream of the moisture absorption assembly in the drying passage, wherein the heater is configured to heat air introduced into the drum and to transfer heat to the external air at the heat exchanger to evaporate moisture from the portion of the moisture absorption assembly in fluid communication with the renewable passage, wherein the drying passage and the dehumidification passage are configured such that heated air exhausted from the drum makes only a single pass through the moisture absorption assembly via the dehumidification passage before reentering the drum, and wherein the renewable passage is provided without a heater between the heat exchanger and the moisture absorption assembly.

2. The drying machine of claim 1, further comprising:

a renewable fan provided in the renewable passage to supply the external air outside the dehumidification passage to an internal space of the renewable passage.

3. The drying machine of claim 1, wherein the moisture absorption assembly further comprises a housing provided to communicate with the drying passage and the renewable passage, respectively, and wherein the desiccant is accommodated inside the housing.

4. The drying machine of claim 3, further comprising:

a motor connected to the moisture absorption assembly to change a location of the desiccant.

5. The drying machine of claim 4, further comprising a controller, wherein the controller is configured to control the motor to rotate the desiccant for a preset reference time.

6. The drying machine of claim 1, wherein the dehumidification passage comprises:

a condensation passage comprising the heat exchanger; and a moisture absorption passage comprising the moisture absorption unit.

7. The drying machine of claim 6, wherein the moisture absorption passage is connected with the condensation passage in series.

8. The drying machine of claim 6, wherein the moisture absorption passage is connected with the condensation passage in parallel.

9. The drying machine of claim 8, further comprising:

a passage change damper configured to selectively supply the air circulated by the circulation fan to both of the condensation passage and the moisture absorption passage or to either one of the condensation passage and the moisture absorption passage.

10. The drying machine of claim 9, further comprising:

a renewable fan provided in the renewable passage to supply the external air into the renewable passage; and a controller, wherein the controller is configured to drive the circulation fan, the renewable fan, and the heater in a condition where the condensation passage is open by the passage change damper and the moisture absorption passage is closed by the passage change damper.

11. The drying machine of claim 9, further comprising a controller, wherein the renewable passage further comprises a renewable fan to supply the external air into the renewable passage, and wherein the controller is configured to stop the heater, and the renewable fan and to drive the circulation fan when the condensation passage is closed by the passage change damper and the moisture absorption passage is open by the passage change damper.

12. The drying machine of 8, further comprising:

a passage change damper to selectively direct the air from the drum to one or both of the condensation passage and the moisture absorption passage, the passage change damper being operable in a plurality of modes including:

a first mode to direct air to the condensation passage and inhibit air movement to the moisture absorption passage, a second mode to direct air to both the condensation passage and the moisture absorption passage, and a third mode to inhibit air movement to the condensation passage and direct air to the moisture absorption passage.

13. The drying machine of 8, further comprising:

a renewable fan provided in the renewable passage to supply the external air outside the dehumidification passage to an internal space of the renewal passage; and a motor to rotate the desiccant absorbing the moisture to change a location of the desiccant.

* * * * *